United States Patent [19]

Oyama et al.

[11] 4,272,698

[45] Jun. 9, 1981

[54] TUBULAR INCANDESCENT LAMP

[75] Inventors: Hiroo Oyama, Hyogo; Takashi Yokouchi, Takasago, both of Japan

[73] Assignee: Ushio Denki Kabushikikaisha, Japan

[21] Appl. No.: 54,177

[22] Filed: Jul. 2, 1979

[51] Int. Cl.[3] ..... H01J 1/88; H01J 19/50; H01K 1/18

[52] U.S. Cl. ..... 313/272; 313/273; 313/274

[58] Field of Search ..... 313/272, 273, 274

[56] References Cited

U.S. PATENT DOCUMENTS

| | | | |
|---|---|---|---|
| 3,194,999 | 7/1965 | Heinlein | 313/272 X |
| 3,295,007 | 12/1966 | Young | 313/274 X |
| 3,758,807 | 9/1973 | Op de Beeck | 313/273 |
| 4,096,405 | 6/1978 | Goto | 313/274 |

*Primary Examiner*—Saxfield Chatmon, Jr.
*Attorney, Agent, or Firm*—Staas & Halsey

[57] ABSTRACT

A long, tubular incandescent lamp has incorporated therein a filament formed by coupling light emitting segments and non-light-emitting segments alternately with each other. Each of the light emitting segments is composed of a light emitting coil and a coil-like coupling member of a larger pitch than the light emitting coil. Each of the non-light-emitting segments is composed of a bar formed to have a straight short-circuit part, bent portions at both ends thereof and supports respectively extending from the bent portions. The short-circuit part is inserted into the coil-like coupling member and these elements are then welded to each other to obtain the filament of alternately coupled light emitting and non-light-emitting segments. The composite filament is subsequently sealed in a long, tubular bulb. Thus, the resulting incandescent lamp is easily assembled, simple in structure, and highly shock resistant.

14 Claims, 13 Drawing Figures

FIG. 1A
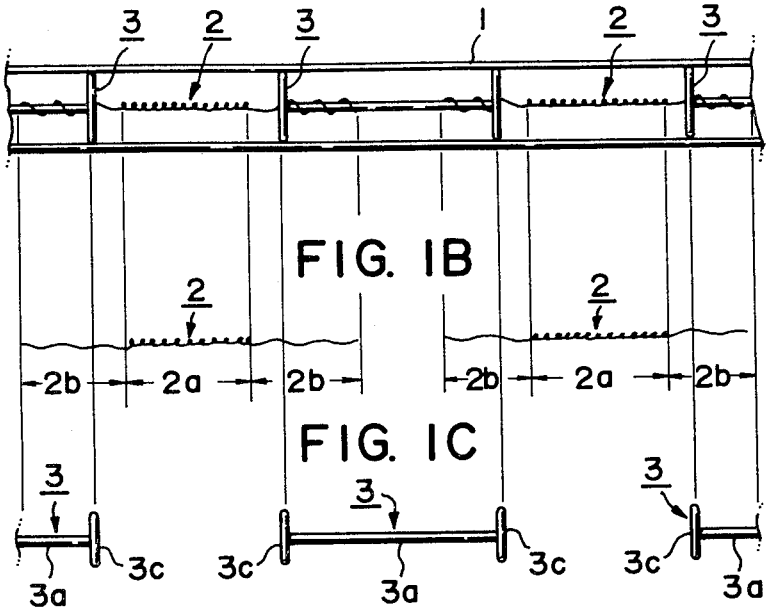
FIG. 1B
FIG. 1C
FIG. 2
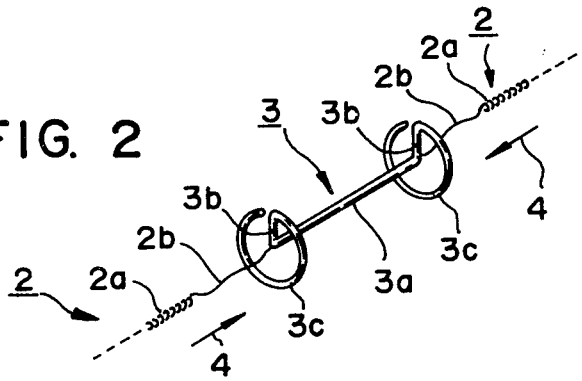

FIG. 6A
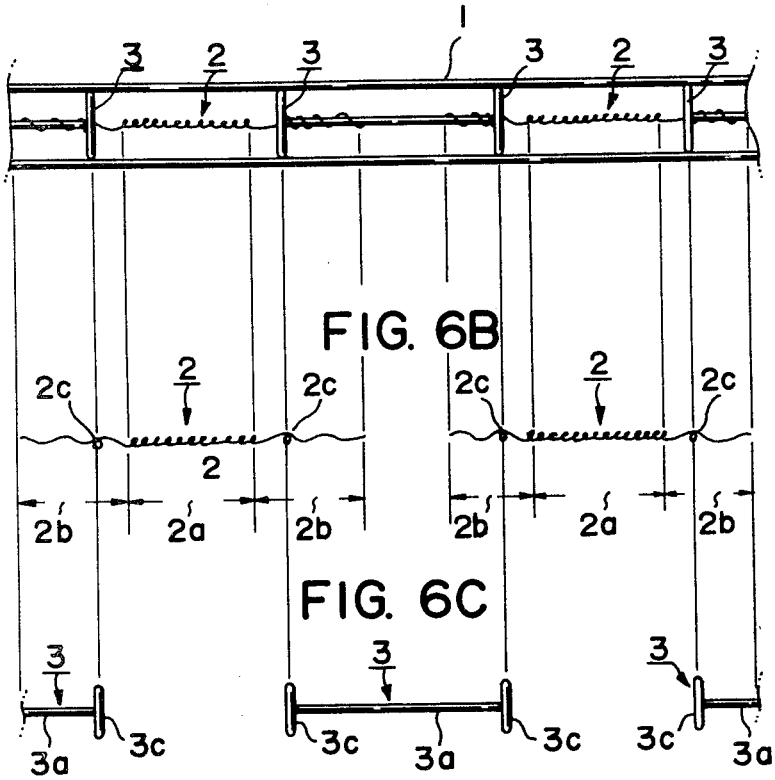
FIG. 6B
FIG. 6C
FIG. 7
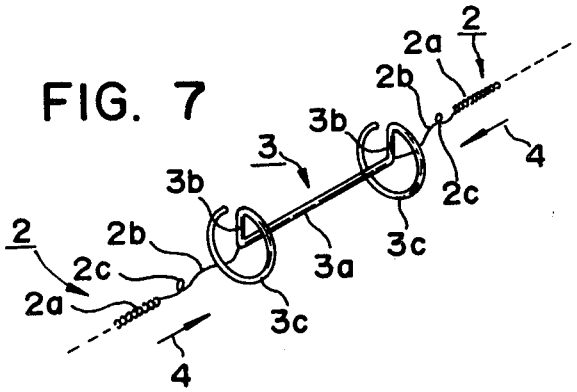

TUBULAR INCANDESCENT LAMP

BACKGROUND OF THE INVENTION

1. Field of the Invention

This invention relates to a tubular incandescent lamp, and more particularly to a long tubular incandescent lamp for use in electronic copying machines which has incorporated therein a filament having non-light-emitting parts.

2. Description of the Prior Art

Many studies and inventions have been made on a long, tubular incandescent lamp for use in electronic copying machines which has incorporated therein a filament having light emitting and non-light-emitting segments.

Recent trends in electronic copying machines employing a lamp of this kind is to speed up operation and reduce power dissipation. To meet these objectives, a very high degree of performance is now required for the lamp used in such copying machines.

For example, to speed up the machine operation, the lamp scanning speed must be increased. In doing so, it is necessary to enhance the shock resistance of the lamp, while appropriately reducing the filament weight and adopting the right structure for the lamp.

To reduce machine power dissipation, the lamp is designed to decrease its power consumption by using a sensitizer of high sensitivity. In doing so, changes in the distribution and quantity of light of the lamp are liable to affect the copying operation; consequently, it is necessary to control the distribution of light with high precision and to reduce the error in changes in the quantity of light.

To fulfill such requirements imposed on the tubular incandescent lamp for use in the electronic copying machine, studies are now being done to obtain an optimum design of the lamp.

Conventional tubular incandescent lamps are roughly divided into the following types:

(a) A segment type in which light emitting and non-light-emitting segments are connected alternately with each other (U.S. Pat. No. 3,416,024).

(b) A short bar type in which continuous coil filament is short-circuited by short bars at a predetermined position (Japanese Utility Model Publication Gazette No. 359/70).

(c) A skipped winding type in which a continuous coil filament is made roughly-pitched at predetermined positions to provide portions which are inhibited to light (U.S. Pat. No. 3,295,007).

(d) A comprise type of the abovesaid types (a) to (c). All these conventional lamps have both merits and demerits, and studies for improvement are being made to keep abreast of developments in the present electronic copying machine art.

SUMMARY OF THE INVENTION

This invention is directed to the abovesaid segment type tubular incandescent lamp and is to provide a novel tubular incandescent lamp which is lightweight, excellent in shock resistance and substantially free from changes in the distribution and quantity of light.

Briefly stated, in the long, tubular incandescent lamp of this invention there is incorporated a filament formed by connecting light emitting and non-light-emitting segments alternately with each other. The light emitting segments are each composed of a light emitting coil and a coil-like coupling member of a pitch larger than that of the light emitting coil. The non-light-emitting segments are each formed with a bar and have a straight short-circuit part, bent portions at both ends thereof and supports respectively extending from the bent portions. The short-circuit part is inserted into the coupling member and welded thereto to form the filament of alternating light emitting and non-light emitting segments.

BRIEF DESCRIPTION OF THE DRAWINGS

FIG. 1(*a*) is explanatory of the principal part of a tubular incandescent lamp embodying this invention;

FIG. 1(*b*) is explanatory of a light emitting segment used in the embodiment of FIG. 1(*a*);

FIG. 1(*c*) is explanatory of a non-light-emitting segment used in the embodiment of FIG. 1(*a*);

FIG. 2 is explanatory of a method for assembling of the light emitting and non-light-emitting segments in the embodiment of FIGS. 1(*a*);

FIG. 6(*b*) is explanatory of a light emitting segment utilized in the embodiment of FIG. 6(*a*);

FIG. 6(*c*) is explanatory of a non-light-emitting segment employed in the embodiment of FIG. 6(*a*);

FIG. 6(*d*) is explanatory of the coupling of the segments 2 and 3 by the sharply rising portion 2*c* at the corner of the bent portion 3*b;*

FIG. 7 is explanatory of a method for assembling of the light emitting and non-light-emitting segments in the embodiment of FIG. 6(*a*);

DESCRIPTION OF THE PREFERRED EMBODIMENTS

Figure 3:
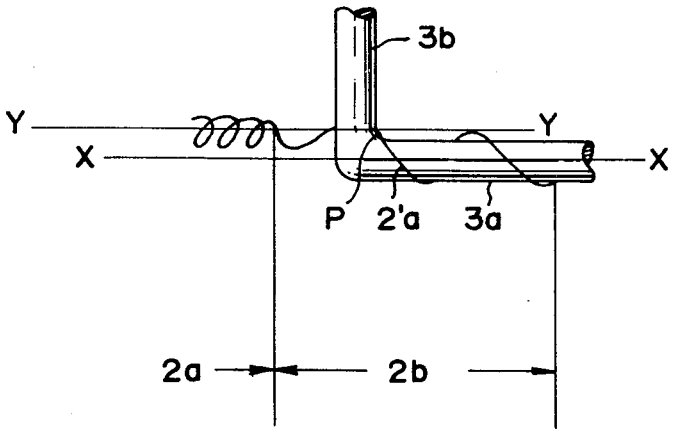
FIG. 3 is an enlarged diagram showing assembling of the light emitting and non-light-emitting segments depicted in FIGS. 1 and 2.

In FIG. 1, reference numeral 1 indicates a quartz bulb; 2 designates ligh emitting segments, each composed of a light emitting coil 2*a* and a roughly-pitched coil-like coupling member 2*b;* 3 identifies non-light-emitting segments, each of which is formed with a bar and is composed of a straight short-circuit part 3*a,* bent portions 3*b* provided at both ends of the bar and ring-shaped supports 3*c* respectively extending from the bent portions 3*b.* As shown in FIG. 2, the light emitting segments 2 and the non-light-emitting segments 3 are assembled together by guiding the coupling member 2*b* of each light emitting segment 2 across the bent portion 3*b* of each non-light-emitting segment 3 in the direction indicated by arrows 4 while turning the segment 2, just like a screw, to entwine around the short-circuit part 3*a* of the segment 3. Then, the coupling member 2*b* is fixed, such as by welding, to the short-circuit part 3*a* at a predetermined position. The light emitting segments 2 and the non-light-emitting segments 3 are thus interconnected alternately with each other to provide a filament disposed in the bulb 1.

Since the light emitting segment 2 is guided across the bent portion 3*b* while being turned, it is preferred that the pitch of the coupling member 2*b* be large, in particular larger than the diameter of the bar. This permits easy assembling of the segments 2 and 3 and prevents deformation of the light emitting segment by eliminating unnecessary force applied thereto. In view of this and the ease in fabricating the light emitting segments 2 and the non-light-emitting segments 3 in accurate configurations, a filament of accurate configuration can be achieved.

The non-light-emitting segment 3 is formed integrally with the supports 3*c*, and has a bar diameter of about 0.2 to 0.6 mm to support sufficiently the filament along the axis of the bulb 1 and to enable the short-circuit part 3*a* to function satisfactorily as a non-light-emitting part. By forming segment 3 with a bar, this segment has the non-light-emitting function and the bulb supporting function and, in addition, is made lightweight by using a minimum member of components and is easy to assemble with the light emitting segment.

While the above is the basic arrangement of the tubular incandescent lamp of this invention, the following features further enhance performance.

FIG. 3 shows, on an enlarged scale, assembling of the light emitting segment 2 and the non-light-emitting segment 3. When the diameter of the bar is about 0.2 to 0.6 mm, the inner side surface P of the bent portion 3*b* usually has a roundness with a radius of about 0.3 to 1.0 mm. Due to this roundness, that part 2'*a* of the coupling member 2*b* which extends around the bent portion 3*b* slides up thereon obliquely to the right or left. This results in the center line Y—Y of the light emitting coil 2*a* deviating slightly from the center line X—X of the straight short-circuit part 3*a*.

Where a substantially high performance in a bulb is required, the abovesaid deviation, though slight, may in some cases have an affect on the non-light-emitting segment. Accordingly, the short-circuit part 3*a* is formed to deviate from the center line of the support 3*c* in a direction reverse to that in which the coupling member 2*b* slides up. This ensures that when a filament is disposed in the bulb, the light emitting coil 2*a* lies in alignment with the bulb axis, although the short-circuit part 3*a* deviates therefrom.

Figure 4:
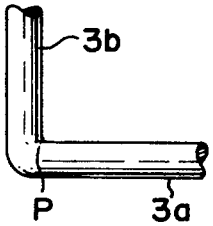
FIG. 4 is explanatory of press forming the inner side surface of the bent portion of the non-light emitting segment of this invention.

To correct this slight deviation it is possible also to press the base of the inner side surface P of the bent portion 3*b* using a sharp tool so as to remove the roundness (FIG. 4).

Figure 5:
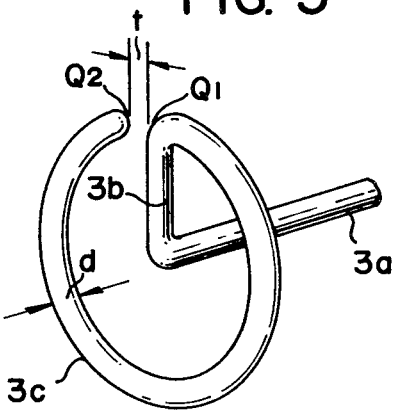
FIG. 5 is explanatory of a support part of the non-light-emitting segment of this invention.

To eliminate possible production control problems by having to carefully control assembly of a number of parts in the structure of this lamp, certain preferred features are incorporated. For example, the support 3*c* of the non-light-emitting segment 3 is formed to loop with one turn and, as shown in FIG. 5, the spacing t between the beginning and terminating points $Q_1$ and $Q_2$ of the support 3*c* is selected to be smaller than the diameter d of the bar. This prevents the light-emitting segments or filaments from being entangled by the non-light-emitting segment 3; consequently, the non-light-emitting segments and filaments become easy to handle and are not deformed by an entanglement, so that a tubular incandescent lamp of excellent performance can be obtained. When the support 3*c* is formed to loop with more than one turn, its bulb supporting ability increases. However, since the diameter of the bar is relatively large, a substantial amount of light is intercepted, exerting a bad influence on the distribution and the intensity of light. If the diameter of the bar is made in the range of about 0.2 to 0.6 mm and the support 3*c* is formed to loop with one turn, it sufficiently fulfils the bar supporting function. Moreover, to design the entire filament to be lightweight as is the case with the tubular incandescent lamp of this invention, it is rather effective to form the support 3*c* with one turn and select the aforesaid spacing t in relationship to the diameter d of the bar.

Figure 6D:
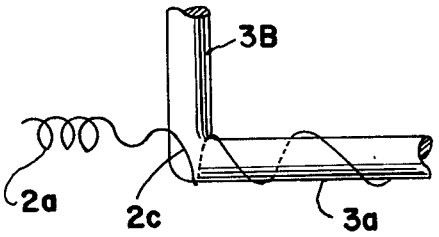
FIG. 6(*a*) is explanatory of the principal part of another embodiment of this invention.

Referring next to FIGS. 6 and 7, another embodiment of this invention will be described. In FIGS. 6 and 7, parts corresponding to those mentioned above are marked with the same reference numerals, and no description will be repeated.

FIG. 6(*a*) is a longitudinal sectional view showing the principal part of the tubular incandescent lamp of this embodiment; FIGS. 6(*b*) and 6(*c*) respectively show light emitting segments and non-light-emitting segments employed in this embodiment; and FIG. 7 depicts assembling of the light emitting segments and the non-light-emitting segments into a filament.

This embodiment differs from the foregoing embodiment in that each coupling member 2*b* includes, at a predetermined position, a sharply rising portion of about one turn or a closely-pitched coil-like portion, identified in FIG. 7 by reference numeral 2*c*.

In assembling a filament of this type the coupling member 2*b* does not easily pass across the bent portion 3*b* of each non-light-emitting segment 3 at the position of the sharply rising portion. Once the filament has been assembled, the sharply rising portion positioned immediately before or after the bent portion 3*b* prevents easy displacement of the light emitting segment 2 and the non-light-emitting 3 relative to each other; consequently, the permanent connection, such as by the aforementioned welding of segments 2 and 3, may be omitted in some cases. The sharp rising portion 2*c* can be used also for indicating the positional relationship between the segments 2 and 3 during assembly to allow ease and accuracy in obtaining the short-circuit distance. With the sharply rising portion of one turn or so, the light emitting segment is hardly deformed; even if it is deformed, this can be corrected by slightly bending both end portions of the short-circuit part 3*a* to deviate in a direction opposite to that of extension of the bent portion 3*b* (as viewed in FIG. 6) in anticipation of a slight deviation of the light emitting coil 2*a* in the direction of extension of the bent portion 3*b* (as viewed in FIG. 6). This slight deviation is usually less than 0.3 mm and sometimes negligible.

Figure 8:
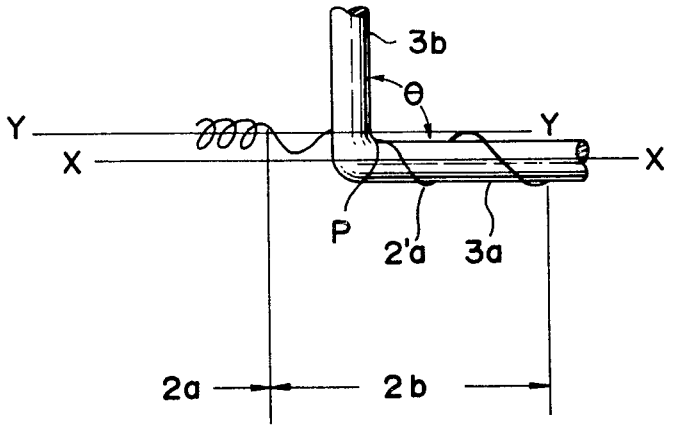
FIG. 8 is an enlarged diagram showing assembling of light emitting and non-light-emitting segments in accordance with still another embodiment of this invention.
Figure 9:
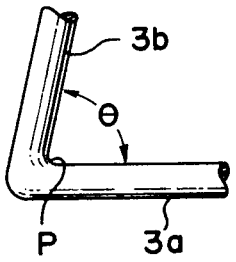
FIG. 9 is explanatory of a modified form of the non-light-emitting segment of this invention.

Referring now to FIGS. 8 and 9, still another embodiment of this invention will be described.

FIG. 8 shows, on an enlarged scale, assembling of the light emitting segment 2 and the non-light-emitting segment 3. When an angle $\theta$ between the bent portion 3*b* and the straight short-circuit part 3*a* of the non-light-emitting segment 3 is about or larger than 90° and the diameter of the bar is approximately 0.2 to 0.6 mm, the inner side surface P of the bent portion 3*b* usually has a roundness with a radius of about 0.3 to 1.0 mm. Due to this roundness, that part 2'*a* of the coupling member 2*b* which extends around the bent portion 3*b* slides up thereon obliquely to the right or left. This results in the center line Y—Y of the light emitting coil 2*a* deviating slightly from the center line X—X of the straight short-circuit part 3*a*.

Where a substantially high performance in a bulb is required, the abovesaid deviation, though slight, may in some cases affect the performance. To avoid this in this embodiment of the invention, in making the non-light-emitting segment, the bend portion 3*b* is slightly inclined towards the straight short-circuit part 3*a* so that the angle $\theta$ between the bent portion 3*b* and the straight short-circuit part 3*a* is decreased, for example, to about 80°. This reduces or prevents the abovesaid "sliding up" problem.

In this case, the roundness of the inner side surface P of the bent portion 3*b* is also reduced; therefore, in accordance with this embodiment of the invention, a tubular incandescent lamp of high performance is again achieved.

As has been described in the foregoing, the tubular incandescent lamp of this invention is lightweight, excellent in shock resistance and easy and accurate to assemble, and, therefore, substantially free from changes in the distribution and quantity of light.

It will be apparent that many modifications and variations may be effected without departing from the scope of the novel concepts of this invention.

What is claimed is:

1. A long, tubular incandenscent lamp comprising:

(a) a tubular-like envelope; and (b) a composite filament of alternating interconnected light-emitting and non-light-emitting segments wherein each non-light-emitting segment is formed of a bar with a straight middle short-circuit portion, bent portions provided at both ends of the middle short-circuit portion and support portions respectively extending from the bent portions and engageable with the inner wall of said envelope, and wherein each light-emitting segment is formed of a single coil having a light-emitting coil portion and a roughly-pitched coil-like coupling portion at the end of the light-emitting coil portion for insertion and connection with the straight short-circuit portion of the non-light-emitting segment.

2. The lamp of claim 1 wherein each support portion is formed in a single circular-like loop.

3. A tubular lamp comprising:

(a) a tubular-like envelope; and (b) a composite filament of alternating interconnected light-emitting and non-light-emitting segments wherein each non-light-emitting segment is formed of a bar with a straight middle short-circuit portion, bent portions provided at both ends of the middle short-circuit portion, and circular-like single loop support portions respectively extending from the bent portions and engageable with the inner wall of the envelope for supporting the filament in the lamp, and wherein each light-emitting segment is formed of a single coil having a light-emitting coil portion and a roughly-pitched coil-like coupling portion at the end of the light-emitting coil portion fixedly connected to the straight short-circuit portion of the non-light-emitting segment.

4. A tubular incandescent lamp according to claim 1, 2 or 3 wherein each of the bent portions is slightly inclined towards the straight short-circuit portion.

5. A tubular incandescent lamp according to claim 1, 2 or 3 wherein the straight short-circuit portion is disposed to deviate from the center line of the support portions.

6. A tubular incandescent lamp according to claim 1, 2 or 3 wherein the coupling portion includes at least one sharply rising portion at a predetermined position, and wherein the sharply rising portion is engaged with the corresponding bent portion.

7. A tubular incandescent lamp according to claim 1, 2 or 3 wherein each bent portion has a press-formed inner side surface.

8. The lamp of claim 1 or 2 wherein the coupling portion is fixedly connected to the straight short-circuit portion.

9. The lamp of claim 1, 2 or 3 wherein the coupling portion is fixedly connected to the short-circuit portion by welding.

10. The lamp of claim 1, 2 or 3 wherein each support portion has starting and terminating ends forming a space therebetween.

11. The lamp of claim 1, 2 or 3 wherein each bent portion is provided at a substantially 90° angle to the middle short-circuit portion.

12. A tubular incandescent lamp according to claim 10, wherein the spacing between the starting and terminating ends of each support portion is smaller than the diameter of the bar of the non-light-emitting segment.

13. The lamp of claim 6 wherein the middle short-circuit portion has ends bent to deviate slightly in a direction opposite to the direction of the corresponding bent portions.

14. The lamp of claim 1, 2 or 3 where the pitch of the coil-like coupling portion of the light-emitting segment is larger than the diameter of the bar of the non-light-emitting segment.

* * * * *

UNITED STATES PATENT AND TRADEMARK OFFICE

CERTIFICATE OF CORRECTION

PATENT NO. : 4,272,698

DATED : June 9, 1981

INVENTOR(S) : Hiroo Oyama et al.

It is certified that error appears in the above-identified patent and that said Letters Patent are hereby corrected as shown below:

*Front page, [73] Assignee, before "Japan" insert --Tokyo,--;
Front page, second column, last line, "13 Drawing Figures" should be --14 Drawing Figures--.
*Column 1, line 19, "is" should be --are--;
*Column 1, line 45, "at a" should be --at--;
Column 1, line 46, "tion" should be --tions--;
Column 1, line 52, "comprise type" should be --composite--.
Column 2, line 19, "FIGS." should be --FIG.--;
Column 2, line 50, "ligh" should be --light--.
Column 3, line 15, "3c," should be --3c--;
*Column 3, line 22, "member" should be --number--;
*Column 3, line 40, "affect" should be --effect--.
Column 4, line 5, "it sufficiently fulfils" should be --the segment 3 is found to satisfactorily fulfill--;
Column 4, line 28, "type" should be --type,--.
*Column 5, line 25, "incandenscent" should be --incandescent--.

Signed and Sealed this

*Thirteenth* Day of *October 1981*

[SEAL]

*Attest:*

GERALD J. MOSSINGHOFF

*Attesting Officer*

*Commissioner of Patents and Trademarks*